US007774927B2

(12) United States Patent
Karrasch et al.

(10) Patent No.: US 7,774,927 B2
(45) Date of Patent: Aug. 17, 2010

(54) WIRE POSITIONING DEVICE FOR A WIRE TERMINATION MACHINE

(75) Inventors: Christopher John Karrasch, Boiling Springs, PA (US); Michael Morris, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/881,577

(22) Filed: Jul. 27, 2007

(65) Prior Publication Data

US 2009/0025208 A1 Jan. 29, 2009

(51) Int. Cl.
*H01R 43/00* (2006.01)

(52) U.S. Cl. ..... 29/748; 29/747; 29/749; 29/755; 29/757; 439/595; 439/590; 439/596; 439/603

(58) Field of Classification Search ..... 29/564.4, 29/566.1, 564.6, 564.7, 564.8, 748, 755, 29/749, 757; 439/595, 590, 596, 603
See application file for complete search history.

(56) References Cited

U.S. PATENT DOCUMENTS 4,653,160 A * 3/1987 Thorkildsen et al. ..... 29/33 M
4,715,100 A * 12/1987 Cross ..... 29/33 M
5,127,147 A * 7/1992 Toyoda ..... 29/566.3
5,709,025 A * 1/1998 Wuyts ..... 29/748
5,758,402 A * 6/1998 Asano et al. ..... 29/564.4
6,141,867 A * 11/2000 Fukada et al. ..... 29/747
6,353,993 B1 * 3/2002 Schrader ..... 29/564.4
6,530,257 B2 * 3/2003 Ooji et al. ..... 72/420
6,637,639 B2 * 10/2003 Miyoshi et al. ..... 228/40
7,240,421 B2 * 7/2007 Miyoshi et al. ..... 29/759
7,318,274 B2 * 1/2008 Ichikawa et al. ..... 29/861
2001/0000367 A1 * 4/2001 Conte ..... 29/868
2004/0143965 A1 7/2004 Ichikawa et al.
2007/0234558 A1 * 10/2007 Takada ..... 29/753

FOREIGN PATENT DOCUMENTS

EP 1 032 095 8/2000

OTHER PUBLICATIONS

ShinMaywa web pages, Feature of series Model TR201 Terminating Machine, www.shinmaywa.co.jp/awp/awp_e/products/201_2.htm dated Oct. 16, 2008.
JAM web page for ACE 700 Full Automatic Insertion Machine, printed Oct. 16, 2008.

(Continued)

*Primary Examiner*—Derris H Banks
*Assistant Examiner*—Azm Parvez

(57) ABSTRACT

A wire positioning device for a termination machine includes a support housing configured to be located proximate to a termination zone of the termination machine. A wire gripping mechanism is coupled to the support housing and defines a wire alignment axis. The wire gripping mechanism is configured to hold a wire along the wire alignment axis. The wire gripping mechanism and wire are movable with respect to the support housing along a linear transfer path that is oriented transverse to the wire alignment axis. An electric actuator is mounted to the support housing and is joined to the wire gripping mechanism. The actuator drives the wire gripping mechanism along the transfer path.

21 Claims, 5 Drawing Sheets

OTHER PUBLICATIONS

ShinMaywa web pages, Feature of series Model TR201 Terminating Machine, www.shinmaywa.co.jp/awp/awp__e/products/201__2.htm dated Oct. 16, 2008.

JAM web page for ACE 700 Full Automatic Insertion Machine, printed Oct. 16, 2008.

* cited by examiner

WIRE POSITIONING DEVICE FOR A WIRE TERMINATION MACHINE

BACKGROUND OF THE INVENTION

This invention relates generally to wire termination machines, and more particularly, to wire position devices for a wire termination machine.

Wire termination machines are used to mechanically attach a terminal to an end of a wire. One exemplary type of machine is a crimping machine, such as a bench termination machine or a leadmaking machine. During the wire termination process, the wire is presented to a termination zone of the crimping machine. During application of the terminal to the wire, the wire is lowered vertically downward toward the terminal, the terminal is crimped to the wire, and the wire is then raised upward again. The lowering and raising of the wire is commonly referred to as a tonk motion. The timing and positional relationship of the wire elevation relative to the terminal during the crimp affects the quality of the crimp.

Typically, the wire termination machines include a transfer arm assembly that holds the wire. The device is spring loaded and movable in a vertical direction during the wire termination process. Conventional wire termination machines include a tonk arm extending from a ram of the wire termination machine that engages the transfer arm assembly during the wire termination process. As the ram moves through a crimp stroke, the tonk arm presses downward against the device, thus moving the wire along the tonk motion.

A problem associated with known wire termination machines is that the movement of the tonk arm is directly associated with the movement of the ram. As such, the timing and movement of the tonk motion are directly tied to the timing and movement of the ram. To obtain a proper final position of the wire with respect to the terminal, the vertical position of the tonk arm must be adjusted. Therefore, when a different wire or a different terminal is used, the position of the tonk arm may need to be manually adjusted by an operator. When the terminator and/or the transfer arm assembly are not properly positioned, the quality of the crimp is reduced. For example, less than all of the wire conductors may be captured within the terminal barrel, or the wire. Additionally, the wire may move too far, or not far enough, during the tonk motion, such that the wire is bent or kinked during the wire termination process. This may lead to poor termination and/or machine jamming.

A need remains for a wire termination machine that can mechanically attach terminals to wires in a cost effective and reliable manner. A need also remains for a wire positioning device that can control the amount of wire movement during the tonk motion. A need also remains for a wire positioning device that can control the timing of wire movement during the tonk action.

BRIEF DESCRIPTION OF THE INVENTION

In accordance with an exemplary embodiment, a wire positioning device for a termination machine is provided, wherein the assembly includes a support housing configured to be located proximate to a termination zone of the termination machine. A wire gripping mechanism is coupled to the support housing and defines a wire alignment axis. The wire gripping mechanism is configured to hold a wire along the wire alignment axis. The wire gripping mechanism and wire are movable with respect to the support housing. An electric actuator is interconnected to the support housing and is joined to the wire gripping mechanism. The actuator drives the movement of the wire gripping mechanism.

Optionally, the electric actuator may be coupled to a programmable controller that is configured to control a position of the wire gripping mechanism with respect to the termination machine. The wire gripping mechanism may be configured to move the wire within the termination zone independent of the operation of the termination machine. A drive shaft may be provided that is driven by the electric actuator and that drives the wire gripping mechanism along a transfer path of the wire gripping mechanism. The drive shaft may extend along a drive axis, wherein the drive axis is perpendicular to the transfer path. A pinion gear may be driven by the electric actuator, wherein the wire gripping mechanism includes a rack which couples to the pinion gear to move the wire gripping mechanism along the transfer path.

In accordance with another exemplary embodiment, a wire termination machine is provided including a termination tool having termination tooling configured to terminate a terminal to a wire in a termination zone, a terminator actuator driving the termination tooling to and from the termination zone, and a wire positioning device. The wire positioning device includes a support housing configured to be located proximate to the termination zone and a wire gripping mechanism coupled to the support housing. The wire gripping mechanism defines a wire alignment axis and is configured to hold a wire along the wire alignment axis. The wire gripping mechanism and wire are movable with respect to the support housing. An electric actuator is provided for driving the wire gripping mechanism along a linear transfer path to position the wire at a predetermined location with respect to the termination zone.

In accordance with a further exemplary embodiment, a wire termination system is provided including a platform and a termination tool supported by the platform. The termination tool has termination tooling configured to terminate a terminal to a wire in a termination zone, wherein the termination zone is positioned at a predetermined vertical height with respect to the platform. A wire stripping tool is supported by the platform and has wire stripping tooling configured to strip insulation from, and expose conductors of, the wire in a wire stripping zone. The wire stripping zone is positioned at a predetermined vertical height with respect to the platform that may be different than the vertical height of the termination zone. A wire positioning device is supported by the platform and has a wire gripping mechanism configured to hold a wire along a wire alignment axis and an electric actuator driving the wire gripping mechanism along a linear transfer path to position the wire at different vertical positions with respect to the platform. The wire positioning device is movable between the termination tool and the wire stripping tool to present the wire to each of the termination zone and the wire stripping zone.

DETAILED DESCRIPTION OF THE INVENTION

Figure 1:
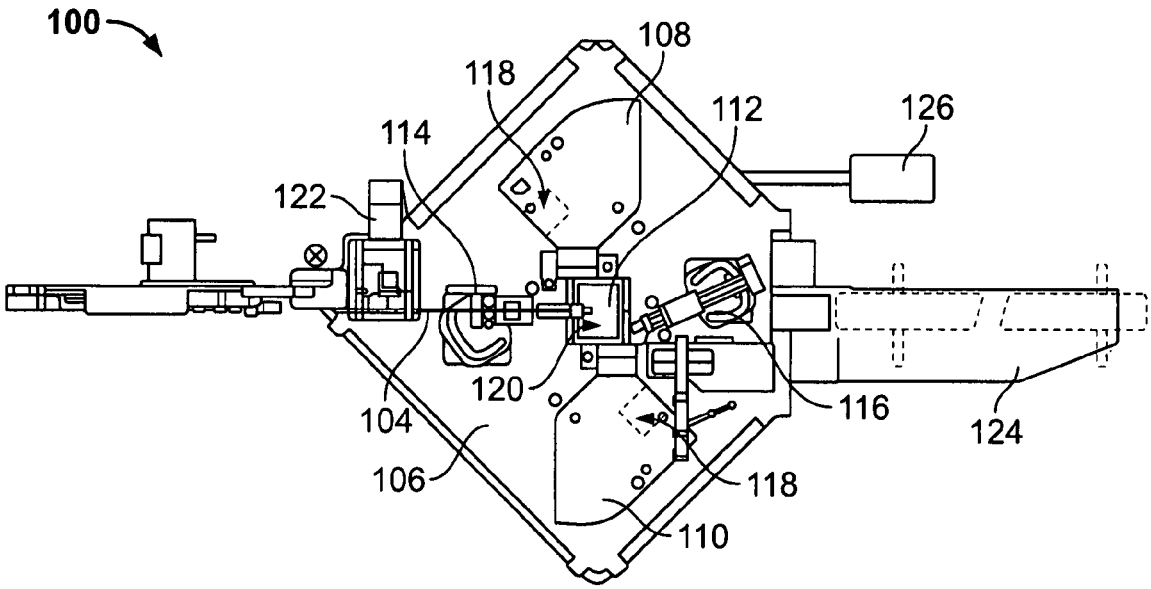
FIG. 1 is a plan view of an exemplary wire termination system formed in accordance with an exemplary embodiment.

FIG. 1 is a plan view of an exemplary wire termination system 100 for terminating a terminal 102 (shown in FIGS. 5 and 6) to a wire 104. The wire termination system 100 includes a platform 106 having multiple stations used in assembling and manufacturing a lead or a terminated wire. In the illustrated embodiment, the system 100 includes first and second termination tools 108 and 110, a wire stripping tool 112, and first and second wire positioning devices 114 and 116 each supported by, and mounted to, the platform 106. The termination tools 108, 110 each include a termination zone 118, in which the terminal 102 is terminated to the wire 104. The wire stripping tool 112 includes a wire stripping zone 120, in which the wire 104 is cut, and insulation is removed from the wire 104, thus exposing conductors of the wire 104. Each of the tools and assemblies of the system 100 are positioned in, and define, different stations of the system 100. The system 100 also includes a wire feeder 122 for supplying the wire 104 to the system 100 and a lead tray 124 for catching the wires 104 that have terminals 102 terminated thereto. A controller 126 is provided for coordinating the operation of each of the components of the system 100.

In an exemplary embodiment, the wire termination system 100 is a lead making machine, however, is not intended to be limited to such a machine. For example, the wire termination system 100 may be a bench machine for terminating terminals to the ends of wires, or another type of machine that is used to attach terminals to the ends of a wire. In the exemplary system, a terminal is applied to each end of a predetermined length or wire to create a lead. For example, a predetermined amount of wire 104 is fed through the wire feeder 122, which corresponds to a desired lead length for the lead. The wire 104 is fed to the first wire positioning device 114 and presented to the wire stripping zone 120. The wire stripping tool 112 is used to cut the wire 104 and strip a predetermined length of the insulation therefrom.

The first wire positioning device 114 then transfers the wire 104 to the termination zone 118 of the first termination tool 108. A terminal 102 is applied to the wire 104, forming one end of a lead or a terminated wire, and the lead is transferred back to the wire stripping zone 120. The wire 104 is then fed to the second wire positioning device 116 by the wire feeder 122. The wire stripping tool 112 cuts and strips the wire 104, forming a second exposed end of the lead. The second wire positioning device 116 transfers the exposed end of the lead to the termination zone 118 of the second termination tool 110. A terminal 102 is then applied to the exposed end of the lead, and the lead is transferred back to the wire stripping zone 120. The lead is then transferred to the lead tray 124.

In an alternative embodiment, rather than transferring the wire between the stations, the wire positioning device may be used at a single station. For example, the wire may be presented directly to a wire positioning device located at a termination tool, such as the first termination tool 108 or a bench machine. The location of the wire positioning device may be fixed relative to the termination tool, but the wire positioning device may be able to control a position of the wire with respect to the termination tool, as is evident from the description below. For example, the wire positioning device may be able to control a vertical position of the wire within the termination zone of the termination tool.

In an exemplary embodiment, the termination tools 108, 110 may be represented by terminal crimping machines used for crimping the terminals 102 to the wires 104, however, other types of termination tools 108, 110 may be used, such as, an IDC machine, a welding machine, and the like that attach terminals 102 to wires 104 using processes other than crimping. The system 100 may also include additional tools at different stations within the system in alternative embodiments. For example, the system 100 may include at least one sealing station, at least one soldering station, and the like. The wire positioning devices 114, 116 may be used to transfer the wire 104 and/or lead to the other various stations.

Figure 2:
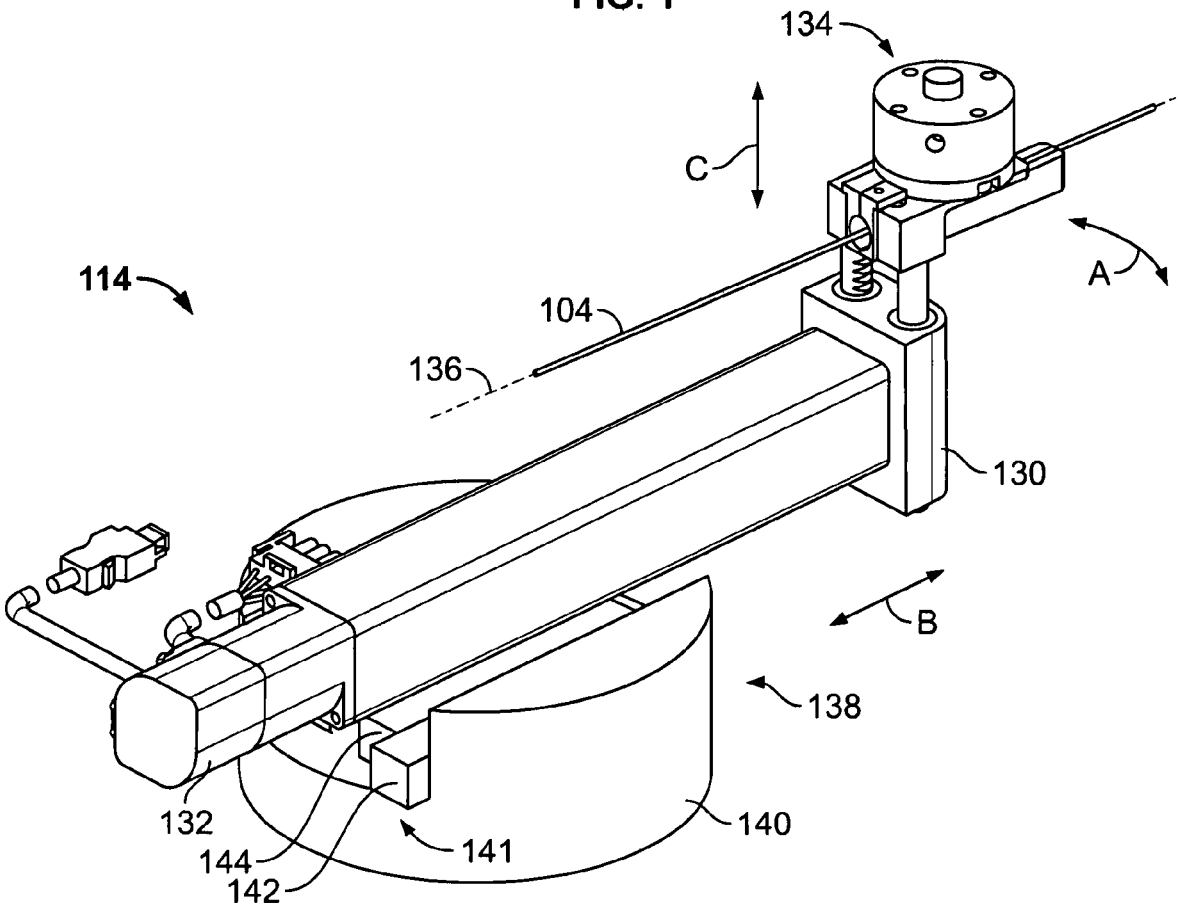
FIG. 2 illustrates a wire positioning device for transferring a wire between stations of the wire termination system illustrated in FIG. 1.

FIG. 2 illustrates an exemplary embodiment of the first wire positioning device 114 for transferring or moving the wire 104 between the stations of the wire termination system 100 (shown in FIG. 1). The second wire positioning device 116 (shown in FIG. 1) may be formed and may operate in a similar manner as the first wire positioning device 114.

The wire positioning device 114 includes a support housing 130, an electric actuator 132 coupled to the support housing 130 and a wire gripping mechanism 134 movably coupled to the support housing 130 and interconnected with the electric actuator 132. The wire gripping mechanism 134 is adapted for gripping and holding the wire 104. The wire 104 is held along a wire alignment axis 136 extending through the wire gripping mechanism 134. In an exemplary embodiment, the wire alignment axis 136 is substantially horizontal and parallel to the platform 106 (shown in FIG. 1). As the wire positioning device 114 is transferred between stations, the wire 104 is held in place by the wire gripping mechanism 134. The wire gripping mechanism 134 is movably coupled to the support housing 130 such that the relative position of the wire 104 with respect to the support housing 130 may be changed. The electric actuator 132 is configured to move the wire gripping mechanism 134 with respect to the support housing 130.

The wire positioning device 114 is mounted to a transfer device 138 for moving the wire positioning device 114 between the various stations. The transfer device 138 includes a rotating hub 140 that rotates between the various stations. The rotating hub 140 operates as a pivot point for the wire positioning device 114, and thus defines a fixed position of the wire positioning device 114 with respect to the platform 106. The transfer device 138 also includes a slide assembly 141 having outer and inner rails 142, 144. The outer rails 142 are mounted to the rotating hub 140 and the inner rails 144 are mounted to the wire positioning device 114. The inner rails 144 are slidably coupled to the outer rails 142 for relative movement between the wire positioning device 114 and the rotating hub 140. However, other types of movement are known to those skilled in the art and may be used to allow relative movement between the wire positioning device 114 and the hub 140.

The wire positioning device 114 is adapted for positioning the wire 104 within a three dimensional coordinate system. While the wire positioning device 114 is illustrated and described as positioning the wire 104 in vertical and horizontal directions, it is realized that the wire positioning device 114 may transfer and/or move the wire 104 in non-horizontal or non-vertical directions. Generally, horizontal movement relates to movement in an X-Y plane and vertical movement relates to movement in a Z direction. Generally, it is assumed that the platform 106 is oriented along the X-Y plane, and thus movement parallel to the platform 106 is considered horizontal movement and movement perpendicular to the platform 106 is considered vertical movement. However, if the platform 106 were oriented non-horizontally, then the wire positioning device 114 may be adapted to move the wire 104 in non-horizontal or non-vertical directions.

The wire positioning device 114 is rotatable and moves the wire 104 along a rotated horizontal transfer path oriented along a horizontal plane, such as in the direction of arrow A. The wire positioning device 114 is moved along the rotated horizontal transfer path to control a relative position of the support housing 130, and thus the wire gripping mechanism 134, with respect to the platform 106. The rotating hub 140 swings the wire positioning device 114 along the rotated horizontal transfer path between the various stations. The rotating hub 140 may be actuated along the rotated horizontal transfer path by an electric actuator, a pneumatic actuator, or otherwise. The wire positioning device 114 moves substantially parallel to the platform 106 as the wire positioning device 114 is moved along the rotated horizontal transfer path.

In addition to the rotated horizontal direction, the wire positioning device 114 also moves the wire 104 along a linear horizontal transfer path, such as in the direction of arrow B. The wire positioning device 114 is moved along the linear horizontal transfer path to control a relative position of the support housing 130, and thus the wire gripping mechanism 134, with respect to the rotating hub 140. Optionally, the linear horizontal transfer path may be oriented substantially parallel to the wire alignment axis 136. The wire positioning device 114 slides between an extended position and a retracted position along the linear horizontal transfer path with relative movement between the outer and inner rails 142, 144. In the extended position, the support housing 130 is furthest from the rotating hub 140 along a given range of motion. In the retracted position, the support housing 130 is closest to the rotating hub 140 along a given range of motion. The wire positioning device 114 may be actuated along the linear horizontal transfer path by an electric actuator, a pneumatic actuator, or otherwise. Optionally, the wire positioning device 114 may be moved in both the rotated and linear horizontal directions independently and/or simultaneously.

The wire positioning device 114 also moves the wire 104 along a linear vertical transfer path, such as in the direction of arrow C. The vertical transfer path is oriented substantially orthogonal to both the rotated and linear horizontal directions. The wire positioning device 114 is moved along the vertical transfer path to control a relative position of the wire gripping mechanism 134 with respect to the support housing 130. The vertical transfer path may be oriented transversely to the wire alignment axis 136. Optionally, the vertical transfer path may be oriented substantially perpendicular to the wire alignment axis 136. The wire gripping mechanism 134 is moved between a raised position and a lowered position along the vertical transfer path. In an exemplary embodiment, the electric actuator 132 moves the wire gripping mechanism 134 along the vertical transfer path. Alternatively, a pneumatic actuator, or some other programmably controlled device, may be used to move the wire gripping mechanism 134 along the vertical transfer path. Optionally, the wire positioning device 114 may be moved along the vertical transfer path independently of, and/or simultaneously with, movement in the rotated and linear horizontal directions.

Figure 3:
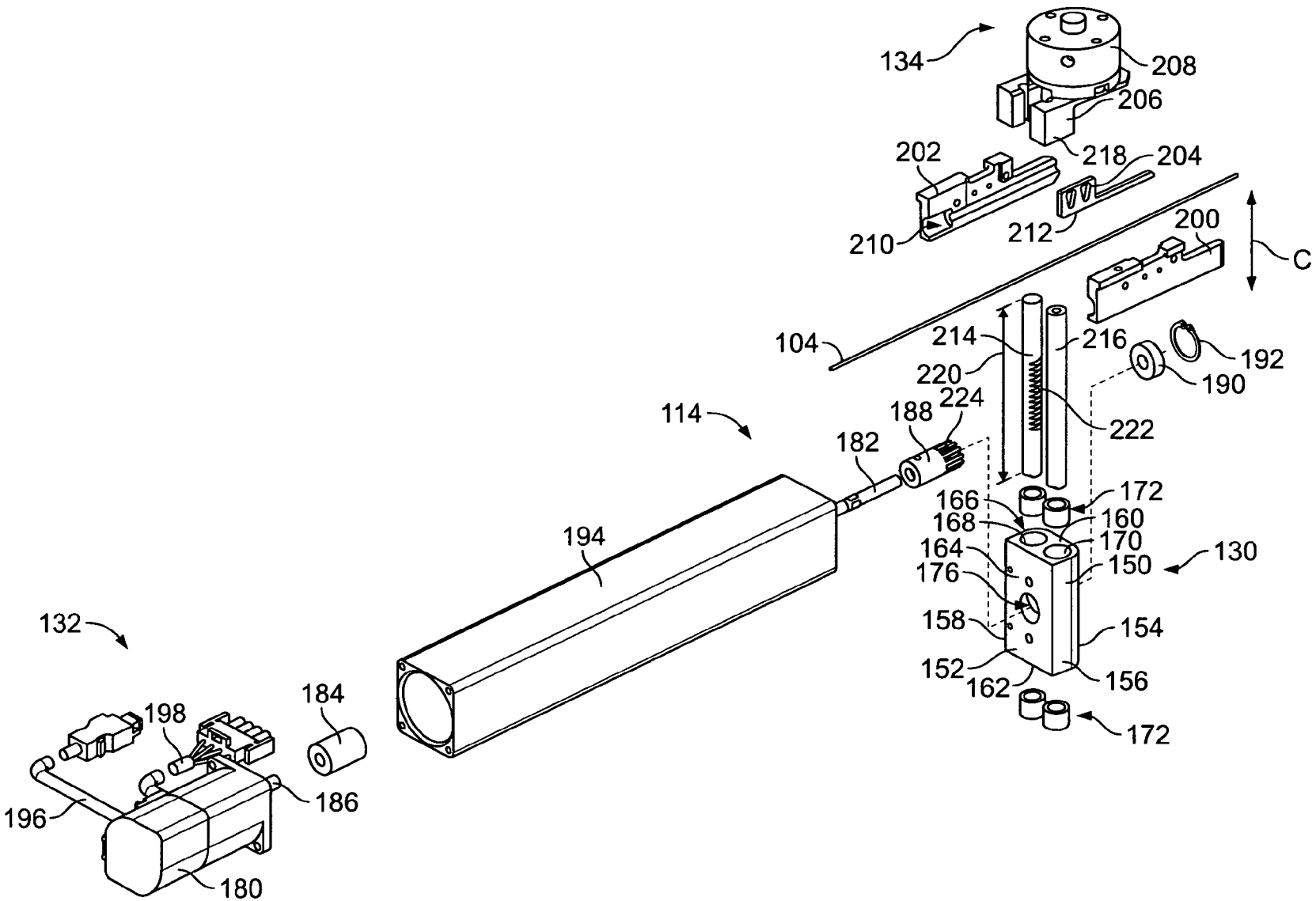
FIG. 3 is an exploded view of the wire positioning device shown in FIG. 2.

FIG. 3 is an exploded view of the wire positioning device 114 illustrating the support housing 130, the electric actuator 132 and the wire gripping mechanism 134. The support housing 130 includes a box-shaped body 150 having front and rear surfaces 152, 154, sides 156, 158, a top 160 and a bottom 162. The front surface 152 defines an electric actuator interface 164 and the top 160 defines a wire gripping mechanism interface 166. The electric actuator interface 164 is generally orthogonal with respect to the wire gripping mechanism interface 166, however alternative configurations are possible in alternative embodiments.

First and second bores 168, 170 extend entirely through the body 150 between the top and bottom 160, 162. The bores 168, 170 receive bearings 172 for the wire gripping mechanism 134. A chamber 176 extends through the body 150 from the electric actuator interface 164. The chamber 176 opens to the first bore 168. As described in further detail below, the chamber 176 receives a portion of the electric actuator 132 therein for driving the wire gripping mechanism 134 between the raised and lowered positions.

The electric actuator 132 includes a motor 180 driving a drive shaft 182. The motor 180 may be operated in both forward and reverse directions. The motor 180 may be operated at a single speed or variable speeds. The motor may be a stepper motor, a servo motor, or another type of motor. A coupler 184 couples a motor shaft 186 to the drive shaft 182. A gear 188, such as a pinion gear, is coupled to an opposite end of the drive shaft 182. The gear 188 is received within the chamber 176 of the support housing 130 and engages the wire gripping mechanism 134, as described in further detail below. Additionally, a drive shaft bearing 190 is received within the chamber 176 for supporting the drive shaft within the chamber 176. A ring 192 is used to hold the drive shaft bearing 192 within the chamber 176.

The electric actuator 132 also includes a drive shaft casing 194 surrounding and protecting the drive shaft 182. The motor 180 is coupled to one end of the casing 194 and the support housing 130 is coupled to the opposite end of the casing 194. The casing 194 is coupled to the support housing 130 at the electric actuator interface 164. Optionally, the inner rail 144 may be coupled to at least one of the motor 180 and the casing 194.

A power cord 196 is connected to the electric actuator 132 for powering the motor 180. A cable 198 interconnects the electric actuator 132 with the controller 126 (shown in FIG. 1). The operation of the electric actuator 132 is controlled by signals transmitted through the cable 198 from the controller 126. Alternatively, signals may be transmitted wirelessly between the electric actuator 132 and the controller 126.

The wire gripper mechanism 134 includes a first wire support 200, a second wire support 202 and a wire gripper 204 for securely holding the wire 104. The first and second wire supports 200, 202 are coupled to a base 206. The base 206 also supports a wire gripper actuator 208 operatively coupled to the wire gripper 204 for moving the wire gripper 204 between an engaged position, wherein the wire gripper 204 engages the wire 104, and a disengaged position, wherein the wire gripper 204 does not engage the wire 104. Optionally, the wire gripper actuator 208 may be pneumatically driven, however, the wire gripper actuator 208 may be driven by other drive mechanisms or means, such as electrically actuated. During loading of the wire 104 into the wire gripper mechanism 134, the wire is first loaded through a bore 210 defined by the first and second wire supports 200. The bore 210 opens to the wire gripper 204 such that the wire gripper 204 may engage the wire 104 during operation. For example, an engagement surface 212 of the wire gripper 204 engages the wire 104 within the bore 210. The wire 104 is loaded through the bore 210 such that a predetermined amount of wire is exposed beyond the end of the bore 210. As explained in further detail below, the exposed portion of the wire 104 is presented to the various stations during assembly of the lead. For example, the wire 104 is presented to the wire stripping zone 120 and the insulation is removed therefrom. Additionally, the wire is presented to the termination zone 118 and the terminal 102 (shown in FIGS. 5 and 6) is applied to the end of the wire 104.

In use, once the wire is properly positioned within the wire gripper mechanism 134, the wire gripper 204 is actuated by the wire gripper actuator 208 from the disengaged position to the engaged position. In an exemplary embodiment, the wire gripper 204 is moved linearly toward the bore 210 during actuation of the wire gripper actuator 208. In the engaged position, the wire gripper 204 securely captures the wire 104 by pressing the wire 104 against the bore 210, and the wire gripper 204 resists axial movement of the wire 104. The wire gripper 204 may be released by the wire gripper actuator 208 to allow further movement of the wire 104.

The wire gripper mechanism 134 further includes first and second guide rods 214 and 216 extending generally vertically from the base 206. Optionally, the first and second guide rods 214, 216 may be securely received within openings (not shown) in the base 206. The guide rods 214, 216 extend generally orthogonally with respect to the wire alignment axis 136 (shown in FIG. 2). In an exemplary embodiment, the guide rods 214, 216 are cylindrically shaped and have a length 220 sufficient to allow a range of vertical movement of the wire gripper mechanism 134, as explained in further detail below. The first guide rod 214 includes teeth 222 along an outer surface thereof. The teeth 222 generally define a rack for the corresponding gear 188. The guide rods 214, 216 are received within the bores 168, 170, respectively, of the support housing 130. The guide rods 214, 216 are movable within the bores 168, 170 along a central axis of the bores 168, 170. In an exemplary embodiment, the guide rods 168, 170 are slidably received within the bearings 172 to ease the movement of the wire gripper mechanism 134.

The first guide rod 214 is received within the first bore 168 such that the teeth 222 engage corresponding teeth 224 of the gear 188. In operation, as the gear 188 is rotated, the first guide rod 214 is moved within the bore 168. Rotational movement of the gear 188 in a forward direction corresponds to upward movement of the first guide rod 214 in the bore 168. Rotational movement of the gear 188 in a rearward direction corresponds to downward movement of the first guide rod 214 in the bore 168. The base 206 is moved by, and in unison with, the first guide rod 214. Similarly, the second guide rod 216 is moved with the first guide rod 214. In this manner, the electric actuator 132, through the drive shaft 182 and gear 188, operates to move the wire gripping mechanism 134 along the vertical transfer path, which is shown in FIG. 3 by the arrow C.

In an alternative embodiment, rather than using the rack and pinion type of arrangement to transfer rotational movement of the motor 180 and drive shaft 182 to linear movement of the wire gripping mechanism 134, the wire positioning device 114 may be arranged differently. For example, the electric actuator 132 may be coupled to the bottom 162 of the support housing 130, and a drive shaft may extend generally vertically upward therefrom. The drive shaft may be threadably coupled to the wire gripping mechanism 134. As such, the threaded drive shaft replaces the guide rod 214 and/or 216 illustrated in FIG. 3.

Figure 4:
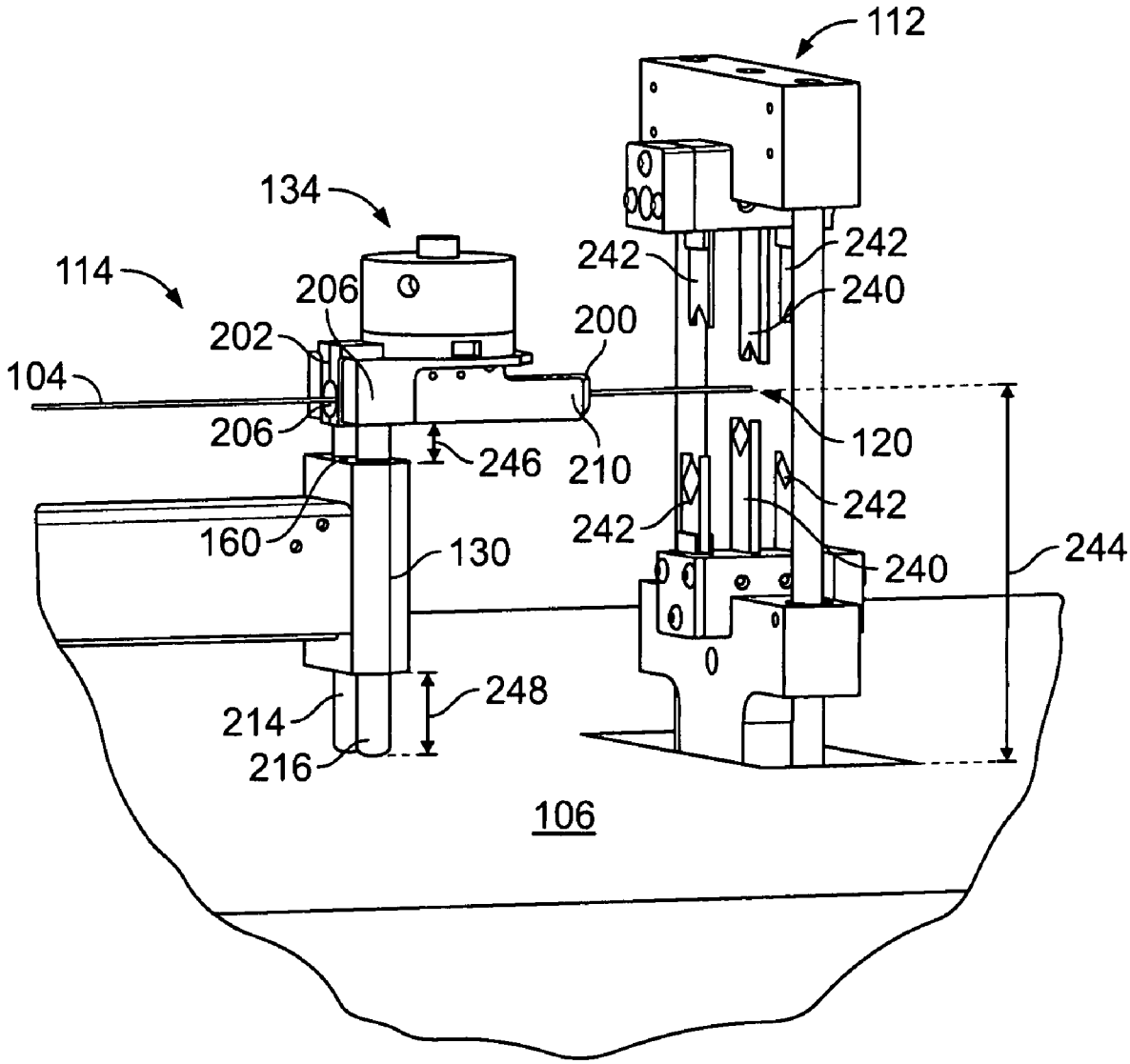
FIG. 4 illustrates the wire positioning device positioning a wire within a wire stripping zone of the wire termination system shown in FIG. 1.

FIG. 4 illustrates the wire positioning device 114 positioning a wire 104 within the wire stripping zone 120 of the wire stripping tool 112. The wire stripping tool 112 includes wire cutting blades 240 for cutting the wire 104, and wire stripping blades 242 for stripping the insulation from the wire 104. The wire stripping tool 112 is pneumatically, electrically or otherwise actuated to move the opposed blades relatively closer to one another to perform the cutting and stripping. The movement of the wire stripping tool 112 may be independent of the movement of the wire positioning device 114.

During operation, the wire 104 is presented to the wire stripping zone 120. The wire positioning device 114 is configured to horizontally and vertically position the wire 104 within the wire stripping zone 120. As described above, the electric actuator 132 (shown in FIG. 3) is used to adjust the vertical position of the wire 104 by moving the wire gripping mechanism 134. In an exemplary embodiment, the wire 104 is positioned substantially centrally between the opposed blades 240 and/or 242. The electric actuator 132 may be programmed to adjust the vertical position of the wire 104 based on changes to the system 100. For example, when a wire 104 having a different wire diameter is used, when blades having different lengths are used, or when other factors are changed, the electric actuator 132 may compensate for the changes and adjust the relative position of the wire gripping mechanism 134, and thus the wire 104.

In the illustrated embodiment of FIG. 4, the wire gripping mechanism 134 includes the first wire support 200, and second wire support 202. The wire gripper 204 is provided but not illustrated in FIG. 4. The wire 104 is loaded into the bore 210. The wire 104 is cantilevered beyond the end of the bore 210. Optionally, and as illustrated in FIG. 4, the bore 210 may be chamfered to direct the wire 104 into a central portion of the bore 210.

In the illustrated embodiment, the wire 104 is positioned at a first height 244 from the platform 106. The base 206 of the wire gripping mechanism 134 is positioned a first distance 246 from the top 160 of the support housing 130. The guide rods 214, 216 extend below the bottom 162 of the support housing 130 for a distance 248. The height 244 and the distances 246, 248 may be varied and adjusted by the electric actuator 132.

Figure 5:
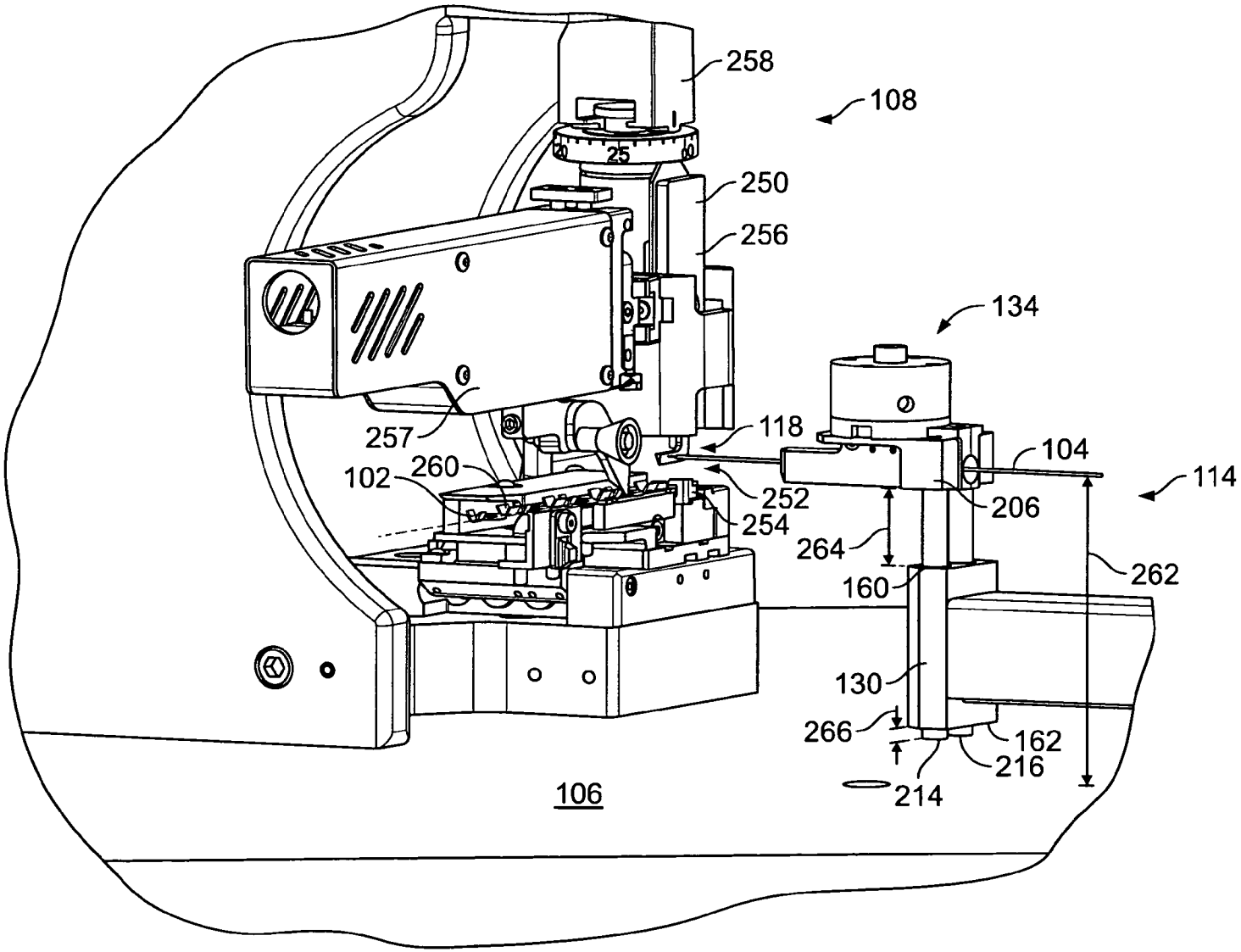
FIG. 5 illustrates the wire positioning device positioning a wire at a first position within a wire termination zone of the wire termination system shown in FIG. 1.
Figure 6:
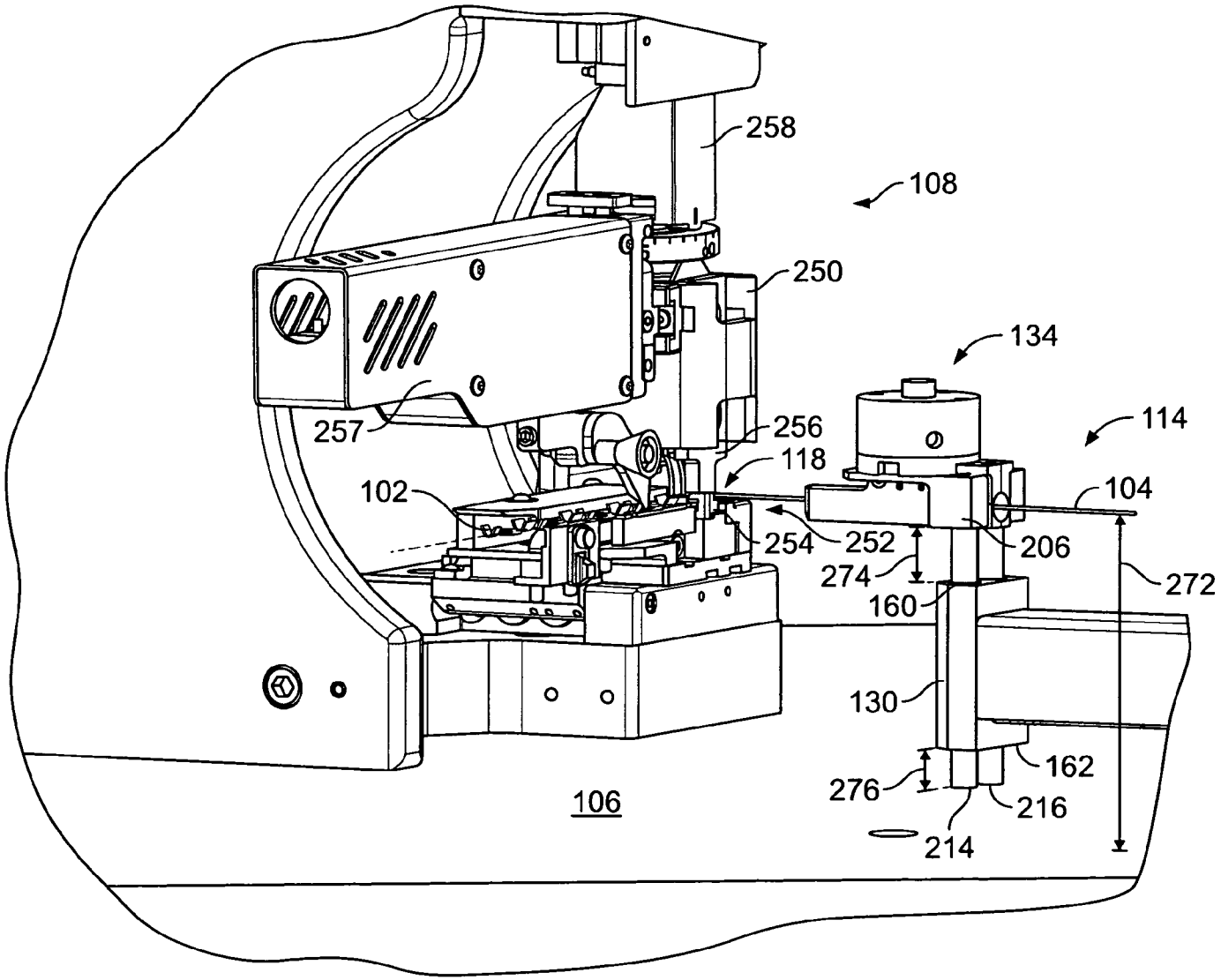
FIG. 6 illustrates the wire positioning device positioning a wire at a second position within the wire termination zone shown in FIG. 5.

FIG. 5 illustrates the wire positioning device 114 positioning a wire 104 at a first, or clearance, position within a wire termination zone 118 of the first termination tool 108. FIG. 6 illustrates the wire positioning device 114 positioning a wire 104 at a second, or termination, position within a wire termination zone 118 of the first termination tool 108. The first termination tool 108 is supported by the platform 106. While the termination tool 108 is described with respect to the first termination tool 108, the components, orientation and operation of the second termination tool 110 may be similar to the first termination tool 108.

The termination tool 108 is illustrated as a terminal crimping machine used for crimping the terminal 102 to the wire 104, however, other types of termination tools 108 may be used. The termination tool 108 includes an applicator 250 having termination tooling 252 for applying the terminal 102 to the wire 104. The termination tooling 252 includes a stationary anvil 254 and a movable crimp tool 256, such as the tool illustrated FIGS. 5 and 6. The termination tool 108 also includes a feeder 257 for feeding the terminals 102 to the termination zone 118.

In operation, the crimp tool 256 is driven by a ram 258 through a crimp stroke. For example, when the ram 258 is lowered, the crimp tool 256 is similarly lowered. The crimp stroke thus has both a downward component and an upward component. FIG. 5 illustrates the termination tool 108 at the top of the crimp stroke and FIG. 6 illustrates the termination tool 108 at the bottom of the crimp stroke. The crimping of the terminal 102 to the wire 104 occurs during the downward component of the crimp stroke, wherein the terminal 102 is crimped to the wire 104 as the crimp tool 256 is lowered toward the anvil 154. For example, when the wire 104 is loaded into an open barrel portion of the terminal 102, ends 260 of the open barrel portion are folded over the wire by the crimp tool 256 to mechanically and electrically join the terminal 102 to the wire 104. The open barrel portion opens upward such that the wire 104 is loaded into the open barrel portion from above the terminal 102. Conventional systems include a tonk arm extending from the ram 258 that engages a wire transfer device to lower and raise the wire transfer device. The wire transfer device is typically spring loaded, such that the tonk arm lowers the wire transfer device, and thus the wire, during the operation of the applicator 250. The wire is thus positioned within the open barrel portion prior to crimping the terminal to the wire, however the timing and amount of movement of the wire 104 is directly controlled by the movement of the ram 258.

In an exemplary embodiment, the wire positioning device 114 vertically transfers the wire 104 independently of the operation of the termination tool 108 and the applicator 250. During operation, the wire 104 is presented to the wire termination zone 118. The wire positioning device 114 is configured to horizontally and vertically position the wire 104 within the wire termination zone 118. In an exemplary embodiment, the wire positioning device 114 positions the wire 104 substantially vertically above, and aligned with, the open barrel portion of the terminal 102. As described above, the electric actuator 132 (shown in FIG. 3) is used to adjust the vertical position of the wire 104 by moving the wire gripping mechanism 134. In an exemplary embodiment, the wire 104 is movable in a vertical direction within the wire termination zone 118 by the electric actuator, such that the wire 104 may be lowered into the open barrel portion of the terminal 102 after being aligned above the terminal 102.

FIG. 5 illustrates the wire 104 at a clearance position, in which the wire 104 may be presented to the wire termination zone 118, unobstructed by the termination tool 108 or the terminal 102. For example, the wire positioning device 114 may present the wire 104 by swinging the wire 104 along the rotated horizontal transfer path. The electric actuator 132 may be programmed to adjust the clearance position of the wire 104 based on changes to the system 100. For example, when a wire 104 having a different wire diameter is used, when a terminal 102 having a different configuration or a different sized open barrel portion is used, or when other factors are changed, the electric actuator 132 may compensate for the changes and adjust the relative position of the wire gripping mechanism 134 with respect to the support housing 130, and thus the wire 104. The adjustment may be made by the preprogrammed controller 126, and adjusted automatically and without adjustment of the termination tool 108.

In the illustrated embodiment of FIG. 5, the wire 104 is positioned at a first vertical height 262 from the platform 106. The base 206 of the wire gripping mechanism 134 is positioned a first distance 264 from the top 160 of the support housing 130. The guide rods 214, 216 extend below the bottom 162 of the support housing 130 for a distance 266. As explained above, the height 262 and the distances 264, 266 may be varied and adjusted by the electric actuator 132. Additionally, the height 262 and the distances 264, 266 may be different than the height 244 and the distances 246, 248 illustrated in FIG. 4 when the wire 104 is presented at the wire stripping zone 120.

FIG. 6 illustrates the wire 104 at a termination position, in which the wire 104 is properly positioned with respect to the terminal 102 for proper termination thereto. For example, the wire 104 may be substantially horizontally positioned within the open barrel portion and may be engaging the terminal 102. FIG. 6 also illustrates the crimp tool 256 in a crimp position engaging and crimping the terminal 102 to the wire 104.

In the illustrated embodiment of FIG. 6, the wire 104 is positioned at a third vertical height 272 from the platform 106. The base 206 of the wire gripping mechanism 134 is positioned a third distance 274 from the top 160 of the support housing 130. The guide rods 214, 216 extend below the bottom 162 of the support housing 130 for a distance 276. As explained above, the height 272 and the distances 274, 276 may be varied and adjusted by the electric actuator 132. Additionally, the height 272 and the distances 274, 276 may be different than the height 244 and the distances 246, 248 illustrated in FIG. 4 when the wire 104 is presented at the wire stripping zone 120 and the height 262 and/or the distances 264, 266 illustrated in FIG. 5 when the wire 104 is at the clearance position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A wire positioning device for a termination machine, wherein the assembly comprises:

a support housing configured to be located proximate to a termination zone of the termination machine;

a wire gripping mechanism coupled to the support housing, the wire gripping mechanism defining a wire alignment axis and configured to hold a wire along the wire alignment axis, the wire gripping mechanism and wire being movable with respect to the support housing;

an electric actuator interconnected to the support housing and having a drive component operatively joined to the wire gripping mechanism, movement of the drive component drives the wire gripping mechanism along a transfer path within the termination zone; and a drive shaft driven by the electric actuator, the drive shaft extending along a drive axis, the drive axis being perpendicular to a transfer path of the wire gripping mechanism.

2. The device of claim 1, wherein the electric actuator is controlled by a programmable controller that is configured to control a position of the wire gripping mechanism with respect to the termination machine.

3. The device of claim 1, wherein the wire gripping mechanism is configured to move the wire within the termination zone independent of the operation of the termination machine.

4. The device of claim 1, wherein the electric actuator transfers the wire gripping mechanism along a linear transfer path that is oriented generally transverse to the wire alignment axis.

5. The device of claim 1, wherein the drive component comprises a pinion gear configured to be driven by the electric actuator, and wherein the wire gripping mechanism includes a rack which couples to the pinion gear to move the wire gripping mechanism along a linear transfer path.

6. The device of claim 1, wherein the wire gripping mechanism includes a guide rod movably received within, and guided by, an opening in the support housing, the guide rod extending along an axis that is parallel to a transfer path of the wire gripping mechanism.

7. A wire positioning device for a termination machine, wherein the assembly comprises:

a support housing configured to be located proximate to a termination zone of the termination machine;

a wire gripping mechanism coupled to the support housing, the wire gripping mechanism defining a wire alignment axis and configured to hold a wire along the wire alignment axis, the wire gripping mechanism and wire being movable with respect to the support housing;

an electric actuator interconnected to the support housing and having a drive component operatively joined to the wire gripping mechanism, movement of the drive component drives the wire gripping mechanism along a transfer path within the termination zone; and a rotating hub and a casing coupled to the rotating hub, the support housing being coupled to the casing and rotated along a transfer plane by the rotating hub, wherein the transfer plane is oriented substantially perpendicular to a transfer path of the wire gripping mechanism.

8. The device of claim 7, wherein the wire gripping mechanism is configured to move the wire within the termination zone in a direction parallel to a termination direction of termination tooling of the termination machine independent of the operation of the termination machine.

9. The device of claim 7, further comprising a slide assembly, the support housing being coupled to the slide assembly and movable along a horizontal transfer path generally toward and away from the termination machine, and generally parallel to the wire alignment axis, by the slide assembly.

10. A wire positioning device for a termination machine, wherein the assembly comprises:

a support housing configured to be located proximate to a termination zone of the termination machine;

a wire gripping mechanism coupled to the support housing, the wire gripping mechanism defining a wire alignment axis and configured to hold a wire along the wire alignment axis, the wire gripping mechanism and wire being movable with respect to the support housing;

an electric actuator interconnected to the support housing and having a drive component operatively joined to the wire gripping mechanism, movement of the drive component drives the wire gripping mechanism along a transfer path within the termination zone; and a slide assembly, the support housing being coupled to the slide assembly and movable along a horizontal transfer path generally toward and away from the termination machine, and generally parallel to the wire alignment axis, by the slide assembly.

11. The device of claim 10, wherein the wire gripping mechanism is configured to move the wire within the termination zone in a direction parallel to a termination direction of termination tooling of the termination machine independent of the operation of the termination machine.

12. The device of claim 10, further comprising a rotating hub and a casing coupled to the rotating hub, the support housing being coupled to the casing and rotated along a transfer plane by the rotating hub, wherein the transfer plane is oriented substantially perpendicular to a transfer path of the wire gripping mechanism.

13. A wire termination machine comprising:

a termination tool having termination tooling configured to terminate a terminal to a wire in a termination zone, the termination tooling being moveable along a termination axis during a termination stroke;

a terminator actuator driving the termination tooling to and from the termination zone during a termination process;

a wire positioning device having a support housing configured to be located proximate to the termination zone and a wire gripping mechanism coupled to the support housing, wherein the wire gripping mechanism defines a wire alignment axis and is configured to hold a wire along the wire alignment axis, the wire gripping mechanism presenting an end of the wire to the termination zone for application of the terminal to the end of the wire during the termination process, and wherein the wire gripping mechanism and wire are movable with respect to the support housing; and an electric actuator driving the wire gripping mechanism along a linear transfer path that is oriented transverse to the wire alignment axis to position the wire within the termination zone during the termination process, wherein the wire positioning device is configured to move the wire parallel to the termination axis within the termination zone synchronously with the termination stroke.

14. The machine of claim 13, wherein the electric actuator drives the wire gripping mechanism to vary the position of the wire within the termination zone as the terminator actuator drives the termination tooling to and from the termination zone.

15. The machine of claim 13, wherein the wire positioning device is configured to move the wire into and out of the termination zone along a horizontal plane, and wherein the electric actuator drives the wire gripping mechanism to a predetermined vertical height as the wire positioning device is transferred into the termination zone.

16. The machine of claim 13, wherein the electric actuator is coupled to a programmable controller that is configured to control a position of the wire gripping mechanism with respect to the termination machine.

17. The machine of claim 13, further comprising a drive shaft driven by the electric actuator, the drive shaft being coupled to the wire gripping mechanism for driving the wire gripping mechanism along the transfer path.

18. The machine of claim 13, further comprising:

a platform supporting the termination tool, wherein the termination zone is positioned at a predetermined vertical height with respect to the platform;

a wire stripping tool supported by the platform and having wire stripping tooling configured to strip insulation from, and expose conductors of, the wire in a wire stripping zone, wherein the wire stripping zone is positioned at a predetermined vertical height with respect to the platform that is different than the vertical height of the termination zone; and wherein the wire positioning device is supported by the platform, the electric actuator positioning the wire at different vertical positions with respect to the platform, wherein the wire positioning device is movable between the termination tool and the wire stripping tool to present the wire to each of the termination zone and the wire stripping zone.

19. The machine of claim 18, further comprising:

a controller for controlling an operation of the electric actuator; and a sensor for determining a vertical position of the wire gripping mechanism with respect to the platform, wherein the controller operates the electric actuator based on the position of the wire gripping mechanism.

20. The machine of claim 18, wherein the wire positioning device is rotated along a horizontal transfer plane between the termination tool and the wire stripping tool, the electric actuator driving the wire gripping mechanism to a predetermined vertical height as the wire positioning device approaches the termination zone, and the electric actuator driving the wire gripping mechanism to a different predetermined vertical height as the wire positioning device approaches the wire stripping zone.

21. The machine of claim 18, wherein the electric actuator moves the wire gripping mechanism along a controlled motion profile.

* * * * *